US006508240B1

(12) United States Patent
Bedwell et al.

(10) Patent No.: US 6,508,240 B1
(45) Date of Patent: Jan. 21, 2003

(54) CYLINDER LINER HAVING EGR COATING

(75) Inventors: Tom Bedwell, Ann Arbor, MI (US); Carmo Ribeiro, Ann Arbor, MI (US); Miguel N. D. De Azevedo, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/954,903

(22) Filed: Sep. 18, 2001

(51) Int. Cl.[7] ..... F02B 75/08
(52) U.S. Cl. ..... 123/668
(58) Field of Search ..... 123/668, 184.61

(56) References Cited

U.S. PATENT DOCUMENTS 4,471,017 A 9/1984 Poeschel et al.
4,567,066 A * 1/1986 Schultz et al. ..... 427/305
4,706,616 A * 11/1987 Yoshimitsu ..... 123/41.84
4,724,819 A 2/1988 Fleri
5,148,780 A * 9/1992 Urano et al. ..... 123/193
5,619,962 A 4/1997 Ikegaya et al.
5,676,096 A 10/1997 Nishi et al.
5,931,213 A 8/1999 Khalili et al.
5,958,332 A 9/1999 Hoeg
6,158,407 A 12/2000 Mizutani
6,178,306 B1 1/2001 Mizoguchi et al.
6,289,872 B1 * 9/2001 Dardalis ..... 123/314

* cited by examiner

*Primary Examiner*—Willis R. Wolfe
*Assistant Examiner*—Jason Benton
(74) *Attorney, Agent, or Firm*—Reising, Ethington, Barnes, Kisselle, Learman & McCulloch P.C.

(57) ABSTRACT

A ferrous cylinder liner for use in diesel engines equipped with exhaust gas recirculation has at least a portion of its inner surface covered by an electroless coating of nickel. The coating has a maximum thickness of 8 micrometers and presents a continuous, non-porous barrier which protects the ferrous liner against attack from the corrosive EGR environment.

13 Claims, 1 Drawing Sheet

CYLINDER LINER HAVING EGR COATING

BACKGROUND OF THE INVENTION

1. Technical Field

The present invention relates generally to cylinder liners for diesel engine applications, and more particularly to liners with protective coatings.

2. Related Art

Diesel engines are widely utilized for providing power for trucks, ships, and construction machines, as well as for use in electrical power generation. In an effort to abate air pollutants such as nitrogen oxides ($NO_x$) present in exhaust gases produced by diesel engines, government regulations may soon require the recirculation of exhaust gases in diesel engines. An exhaust gas recirculation system (EGR) may be utilized as a means of controlling $NO_x$ emissions, but also produces an environment within the engine that is characterized by increased corrosive potential compared to a non-EGR combustion system. An EGR system increases the potential for the production of organic acids and other corrosive elements that could attack the usual coated and non-coated ferrous cylinder liners.

U.S. Pat. No. 4,706,616 discloses a cylinder liner that includes a coating of a wear and seizure resistant ceramic material and may not provide an adequate barrier to U.S. Pat. No. 5,619,962 discloses an electroplated wear and seizure resistant coating for a cylinder.

It is therefore an object of the present invention to provide a ferrous cylinder liner that is protected against attack from an EGR environment in diesel engines.

SUMMARY OF THE INVENTION

A cylinder liner for a diesel engine having exhaust gas recirculation (EGR) includes a ferrous cylinder liner body having an inner surface. The inner surface is covered by a continuous, non-porous EGR coating of electroless nickel which presents a barrier to the EGR environment.

The cylinder liner has the advantage of providing a continuous electroless nickel barrier layer that does not require additional machining or finishing after the barrier layer has been applied. Because there is no additional machining, the coating remains continuous to protect the cylinder liner from the corrosive EGR environment.

The electroless coating can be applied in a uniform, thin layer such that the dimensional tolerances of the cylinder can be maintained without the use of further finishing operations after the coating has been applied. This arrangement allows for an economical corrosion resistant part to be produced without complex machining of the cylinder liner or the cylinder of a diesel engine to accommodate the thickness of a coating.

BRIEF DESCRIPTION OF THE DRAWINGS

These and other features and advantages of the present invention will become more readily appreciated when considered in connection with the following detailed description and appended drawings, wherein.

DETAILED DESCRIPTION

Figure 1:
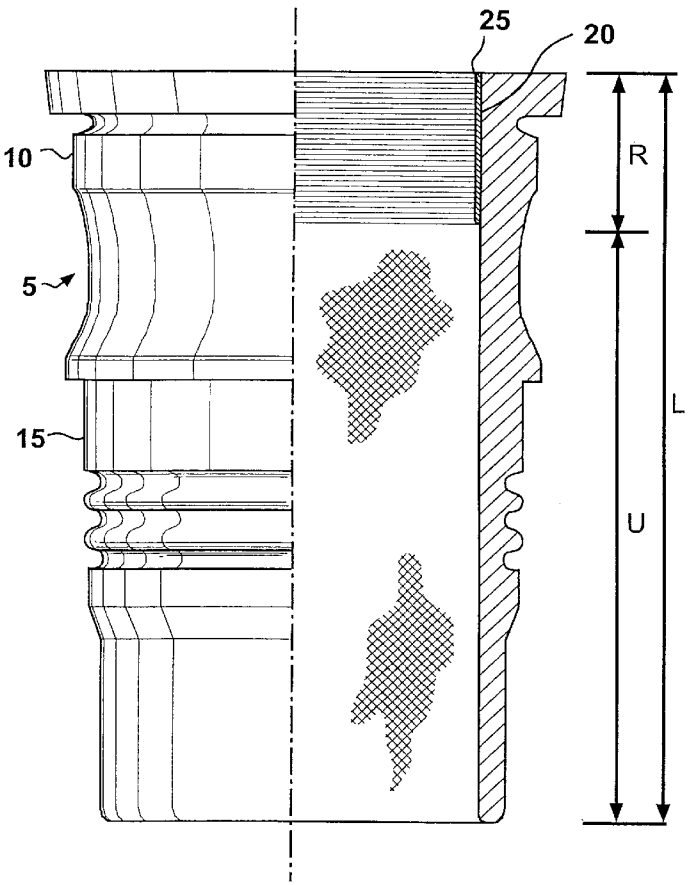
FIG. 1 is a sectional view of a cylinder liner according to the present invention.

With reference to FIG. 1, there is shown the corrosion resistant cylinder liner 5 for use in an exhaust gas recirculation (EGR) diesel engine. The cylinder liner 5 includes a cylinder liner body 5 having an upper portion 10 and a lower portion 15 which define an overall length L of the cylinder liner 5. The length of the upper portion 10 is designated as R and the length of the lower portion 15 is designated as U. The sum of the lengths R and U total the overall length L of the cylinder liner 5.

The cylinder liner 5 also includes an inner surface 20. The inner surface 20 includes a coating 25 applied to at least a portion of the inner surface 20. The coating 25 is preferably an electroless coating of nickel having a maximum thickness of 8 micrometers. The coating 25 serves as a barrier which protects the ferrous cylinder liner 5 from corrosive attack by the EGR environment of the diesel engine. The coating 25 is preferably applied only to the upper portion 10.

Electroless nickel plating, also known as chemical or autocatalytic nickel plating, chemically deposits the nickel on the inner surface 20 without the use of an external current source (i.e., non-electroplated). The coating operation is based upon the catalytic reduction of nickel ions on the surface being coated. Electroless nickel deposition applies the EGR coating 25 at a uniform rate and depth and is relatively insensitive to surface geometry, unlike electrolytic plating which varies the current density and thus coating depth and is not capable of applying such a thin, uniform, continuous, non-porous coating as with the electroless coating of the invention. In this manner a uniform coating can be formed over the part regardless of the part geometry. The electroless nickel coating 25 forms a continuous and non-porous barrier for protection of the ferrous cylinder liner 5.

The length of the upper portion 10 is preferably from about 15 to 25% of the overall length L of the cylinder liner 5. The range of 15 to 25% of the overall length L has been found to be sufficient to protect the upper portion 10 from corrosion by an EGR environment.

The electroless nickel coating 25 preferably has a thickness ranging from about 3 to 8 micrometers and more preferably of about 5 micrometers. At thicknesses less than about 3 micrometers, the coating 25 does not provide adequate barrier protection to the cylinder liner 5. At thicknesses greater than about 8 micrometers, the coating interferes with the dimensional tolerancing of the cylinder liner 5 and would thus require machining or finishing operations after the coating has been applied.

After the coating 25 is applied, there is preferably no further machining or finishing of the coated surface 20 such that the coating 25 remains continuous and non-porous to maintain its protective qualities. The cylinder liner 5 is machined or finished to its final specifications before the electroless nickel coating 25 is applied. Because of the uniform nature of the electroless nickel coating 25, as well as the relatively thin character of the coating 25, no further machining or finishing of the coating 25 is required before the cylinder liner 5 is installed in an engine.

Figure 2:
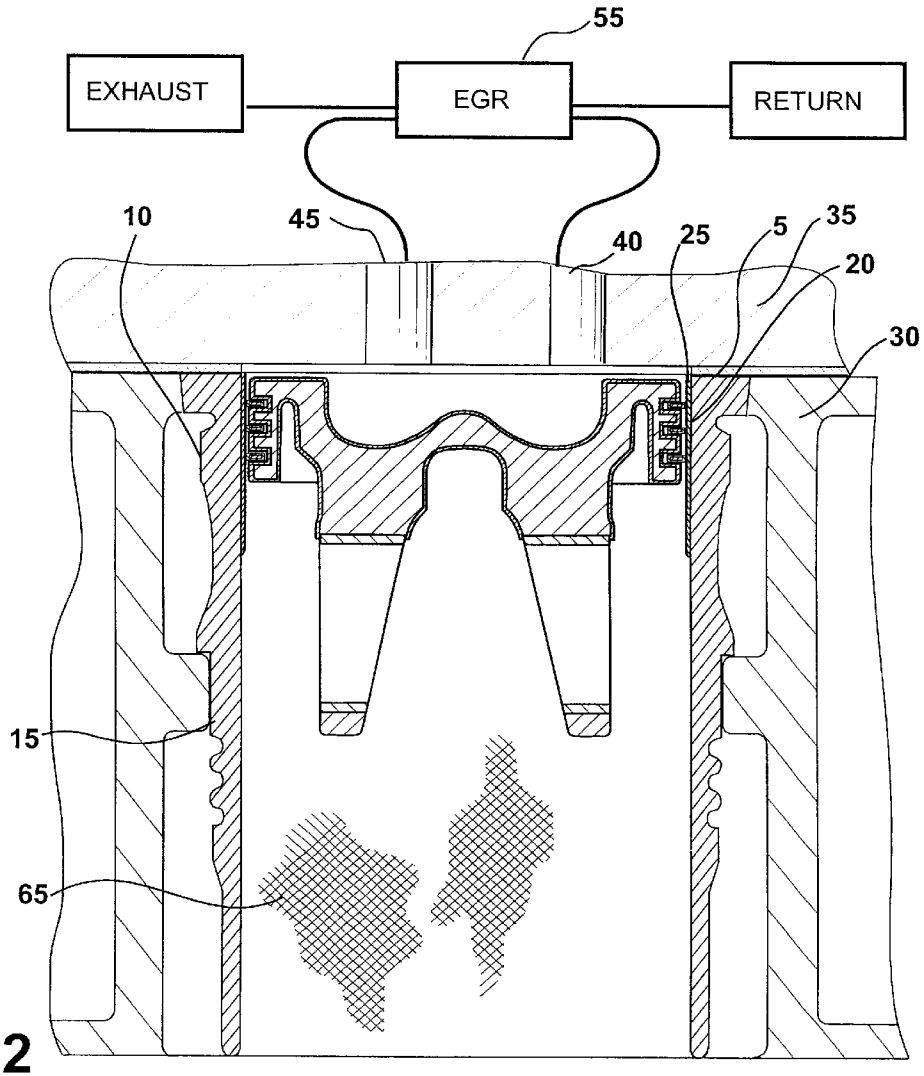
FIG. 2 is an environmental view of a diesel engine with EGR shown fitted with a cylinder liner according to the present invention.

With reference to FIG. 2, there is shown an environmental view of the cylinder liner as used in a diesel engine. After the coating 25 is applied to the cylinder liner 5, no further finishing is required, and the cylinder liner is installed in the cylinder block 30 of the engine. The inner surface 20 provides a running surface for guiding a reciprocating piston 65.

The cylinder block 30 mounts a cylinder head 35 which has an intake port 45 and an exhaust port 40. Exhaust gases exiting the exhaust port 40 are processed through an exhaust gas recirculating (EGR) system 55 which redirects at least a portion of the uncombusted exhausted gases back into the cylinder through the intake port 45 for combustion.

At least the upper portion 10 of the cylinder liner 5 is protected from the EGR environment by the electroless nickel coating 25.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A cylinder liner for a diesel engine having exhaust gas recirculation, comprising:

a ferrous cylinder liner body having an inner surface; and an EGR coating of electroless nickel applied to at least a portion of said inner surface and providing a continuous, non-porous barrier against corrosive effects of the exhaust gas recirculation environment of the diesel engine, wherein said EGR coating has a ready to use surface finish in its as-applied condition.

2. The cylinder liner of claim 1 wherein said EGR coating has a maximum thickness of 8 micrometers.

3. The cylinder liner of claim 1 wherein said EGR coating is applied to only an upper portion of said inner surface.

4. The cylinder liner of claim 3 wherein said upper portion has a length of from 15 to 25 percent of an overall length of said cylinder liner body.

5. The cylinder liner of claim 1 wherein said coating has a thickness of about 3 to 8 micrometers.

6. The cylinder liner of claim 1 wherein said coating has a thickness of about 5 micrometers.

7. A cylinder liner for use in diesel engines having exhaust gas circulation, comprising:

a ferrous cylinder liner body having an inner surface; and an EGR coating of electroless nickel applied to at least a portion of said inner surface to a maximum thickness of about 8 micrometers and providing a continuous, non-porous barrier with a ready-to-use surface finish in its as-applied condition to protect said ferrous liner body against corrosive attack by the exhaust gas recirculation environment of the diesel engine.

8. A method of manufacturing a cylinder liner for use in diesel engines having exhaust gas recirculation comprising:

providing a ferrous cylinder liner body having an inner surface;

final finishing the inner surface to a predetermined surface finish;

applying a continuous, non-porous electroless EGR nickel coating to at least a portion of the inner surface; and installing the coated cylinder liner body in a diesel engine with the EGR coating in its as-applied condition.

9. The method of claim 8 wherein the coating is applied to only an upper portion of the inner surface.

10. The method of claim 9 wherein the upper portion of the liner is selected to have a length of from about 15 to 25 percent of the overall length of said cylinder liner.

11. The method of claim 8 wherein the EGR coating is applied to a maximum thickness of about 8 micrometers.

12. The method of claim 8 wherein the EGR coating is applied to a thickness of about 3 to 8 micrometers.

13. The method of claim 8 wherein the EGR coating is applied to a thickness of about 5 micrometers.

* * * * *